US005682978A

United States Patent [19]

Kawase

[11] Patent Number: 5,682,978

[45] Date of Patent: Nov. 4, 1997

[54] MULTIPLE CIRCUIT SWITCHING DEVICE WITH DRAIN PASSAGE

[75] Inventor: Toshihiro Kawase, Aichi, Japan

[73] Assignee: Kabushiki Kaisha Tokai Rika Denki Seisakusho, Aichi, Japan

[21] Appl. No.: 305,979

[22] Filed: Sep. 19, 1994

[30] Foreign Application Priority Data

Sep. 20, 1993 [JP] Japan ..... 5-050955 U

[51] Int. Cl.[6] ..... H01H 21/08

[52] U.S. Cl. ..... 200/302.1; 200/5 R; 200/302.3

[58] Field of Search ..... 200/302, 1.333, 200/341, 5 R, 5 A, 18, 42.01, 51.03, 51.04, 51.06, 61.58 R, 61.58, 510, 520, 547, 549, 550, 552, 243, 245, 302.3

[56] References Cited

U.S. PATENT DOCUMENTS 4,861,950 8/1989 Yanai et al. ..... 200/5 R 4,968,862 11/1990 Maeda ..... 200/5 R 5,034,572 7/1991 Kouno et al. ..... 200/5 R 5,117,074 5/1992 Yanai et al. ..... 200/302.1

*Primary Examiner*—Renee S. Luebke

*Attorney, Agent, or Firm*—Finnegan, Henderson, Farabow, Garrett & Dunner, L.L.P.

[57] ABSTRACT

A switching device with drain passages includes a switch body having at least one drain aperture opening onto a side wall of the switch body, a base plate provided in the switch body, an operation knob provided in the switch body so as to be pushed therein, an elastic member arranged on the base plate, the elastic member including a contact holder portion, which is elastically deformable, for switching a first switching member in response to a pushing operation of the operation knob, a switching knob provided near the operation of the operation knob and a contact holder for switching a second switching member in response to a switching operation of the switching knob, the contact holder slidably arranged on the base plate.

4 Claims, 6 Drawing Sheets

MULTIPLE CIRCUIT SWITCHING DEVICE WITH DRAIN PASSAGE

BACKGROUND OF THE INVENTION

1. Field of the Invention

The present invention relates to a switching device which is provided with a first switching element to be switched on the basis of an operation of an operating knob and with a operation of a changeover knob.

2. Related Art

A switching device in the following construction (Refer, for Example, to the Japanese Utility Model Application No. 35718/88) is available as a switching device, for example, for controlling a motor for an electric mirror installed respectively on the left door and the right door of a motor car.

More specifically, the switching device is provided with an operating knob which, being installed on the switch body, can be operated for its swinging motion in any of four directions and is also provided with an elastic member made, for example, of silicone rubber and having a plural number of elastically deformable contact holders, which, being pushed down on the basis of a swinging operation of the operating knob, performs a switching operation for an operating switch on a wiring board arranged within the switch body. In addition, the switching device is formed in a construction with a changeover knob is provided in an opening formed in the central area of the operating knob in such a manner as to permit the changeover knob to slide in the horizontal direction and with contact holders provided on the above-mentioned wiring board and operates the changeover switch for a switching operation while the changeover knob slides on the wiring board by the effect of its sliding operation.

However,a switching device in the construction described above is capable of enabling the user to select one of the left mirror and the right mirror by performing a switching operation of the changeover switch by operating the changeover knob so as to perform a sliding motion and then to adjust the direction of the mirror on a selected side upward, downward, leftward, or rightward by performing a switching operation of the operating switch by operating the operating knob so as to set it into its performance of a swinging motion.

As the switching knob is desposed in a region of the operational knob in this type of switch device, there is a possibility that water enters the switch body through an opening formed at the center of the operational knob.

SUMMARY OF THE INVENTION

It is an object of the present invention to provide a, switch in which the changeover knob is disposed in a region of the operational knob, and it possible to positively prevent water from entering the switch body onto the base board side.

According to an aspect of the present invention, there is provided a switch device comprising: a switch body having a portion section for vertically partitioning the inside of said switch body; a base board or plate provided in said switch body being disposed at a lower position of said partition section; an operating body including a first operational knob and a second operational knob, with the first operational knob having an opening at the center; a holding body attached to a lower portion of said operating body under the condition that a space is formed in the lower portion of said operating body; a first operational knob attached to said switch body, being disposed at an upper position of said partition section; a first switch element provided on said base board, being switched in accordance with the operation of said first operational knob; a second operational knob provided in a space of said first operational knob such that said second operational knob faces said opening, said second operational knob having a lever for penetrating holes formed in said holding body and said partition section; a second switch element provided on said base board, being switched through said lever in accordance to said second knob, said cover covering the penetration hole of said holding body; a drain hole provided on an outer circumference of said holding body, said drain hole guiding water on said holding body onto an opening for draining water on said portion section to the outside of said switch body, said opening being provided in said switch body.

In the case where the water enters the switch body through the opening of the operational body of the operational knob, the water flows on an upper surface of the cover of the changeover knob onto the holding body side of the operational knob. After the water has been received by the holding body, it flows down to the portion section of the switch body through a drain hole provided on the outer circumferential portion. After water has flown down to the partition section, it is discharged from an opening for draining to the outside of the switch body.

DETAILED DESCRIPTION OF PREFERRED EMBODIMENTS

Figure 1:
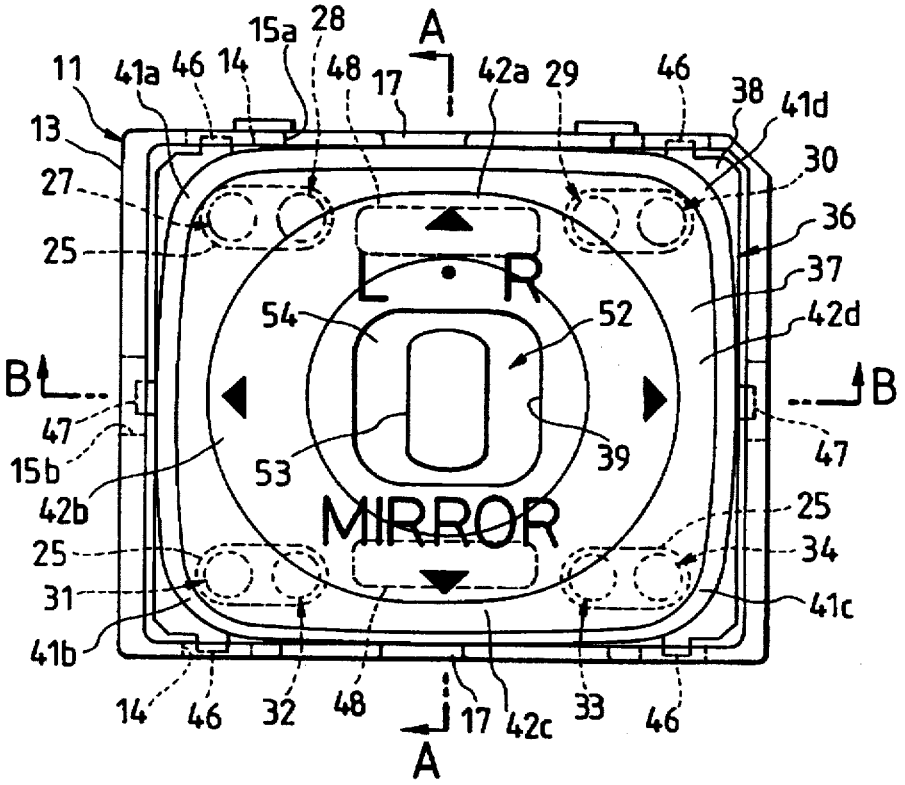
FIG. 1 is a plan view illustrating a first example of a preferred embodiment of the present invention.
Figure 2:
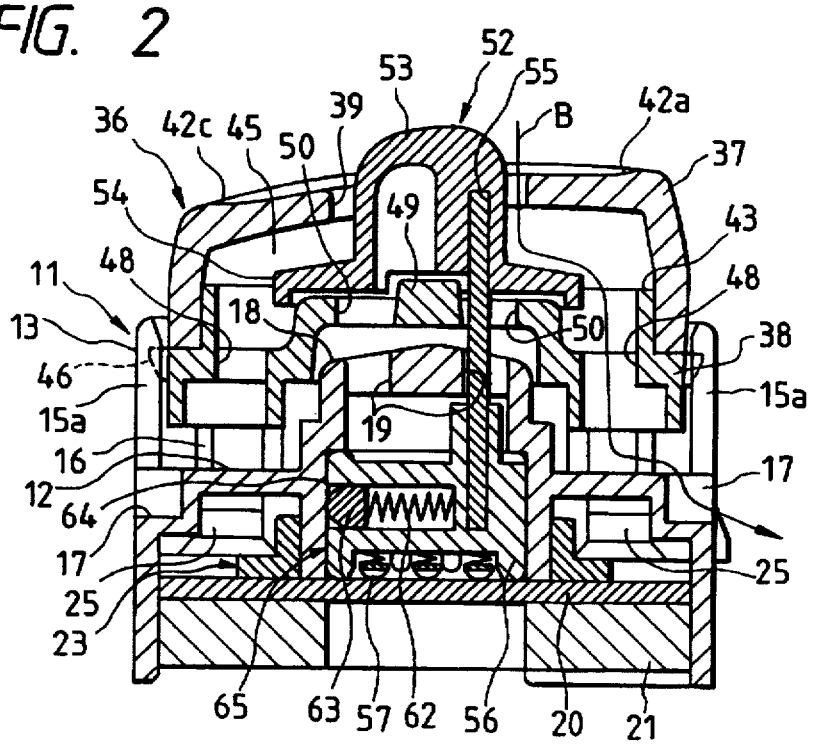
FIG. 2 is a sectional view illustrating the switching device taken along the line A—A in FIG. 1.
Figure 3:
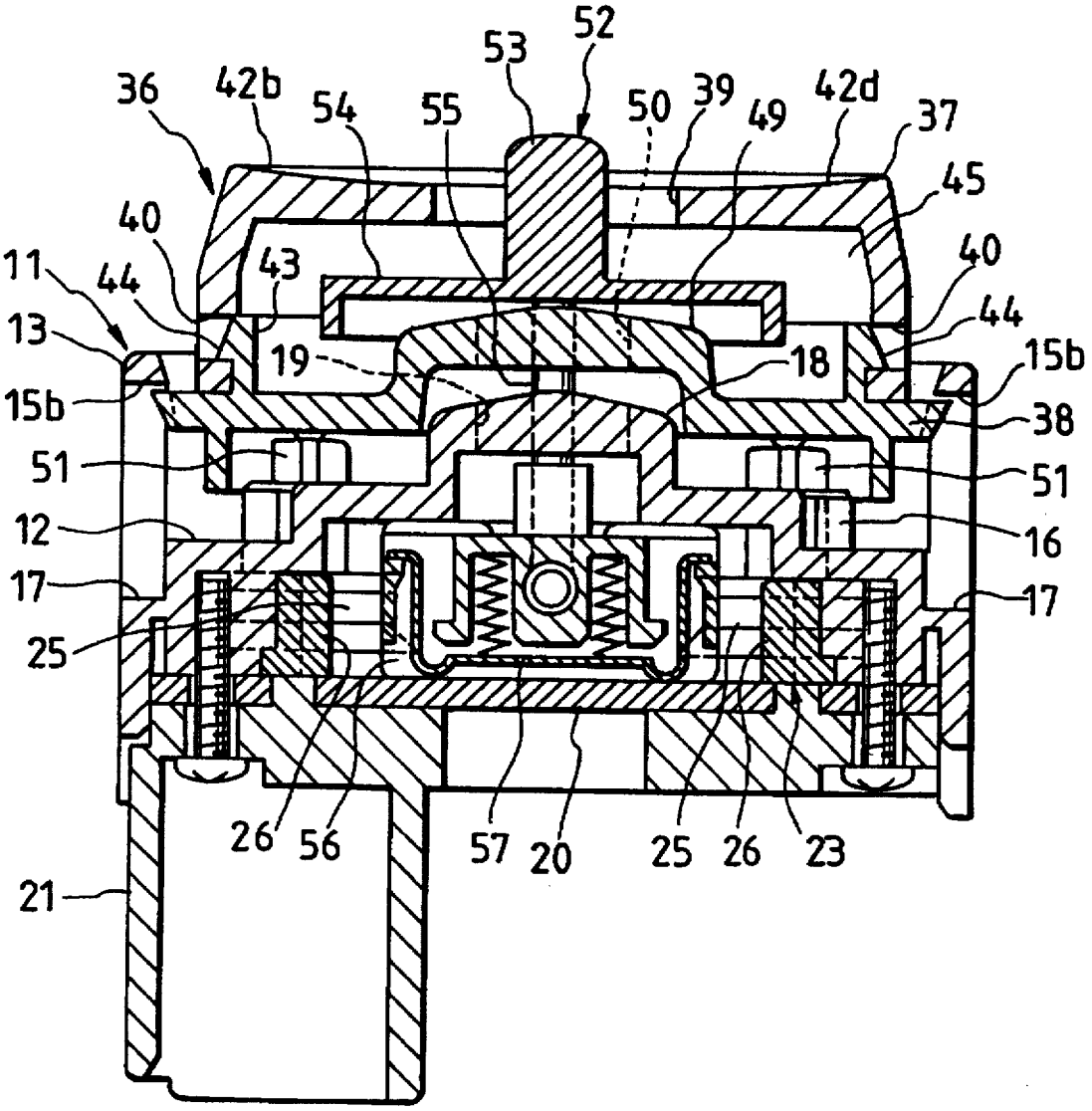
FIG. 3 is a sectional view illustrating the switching device taken along the line B—B in FIG. 1.
Figure 4:
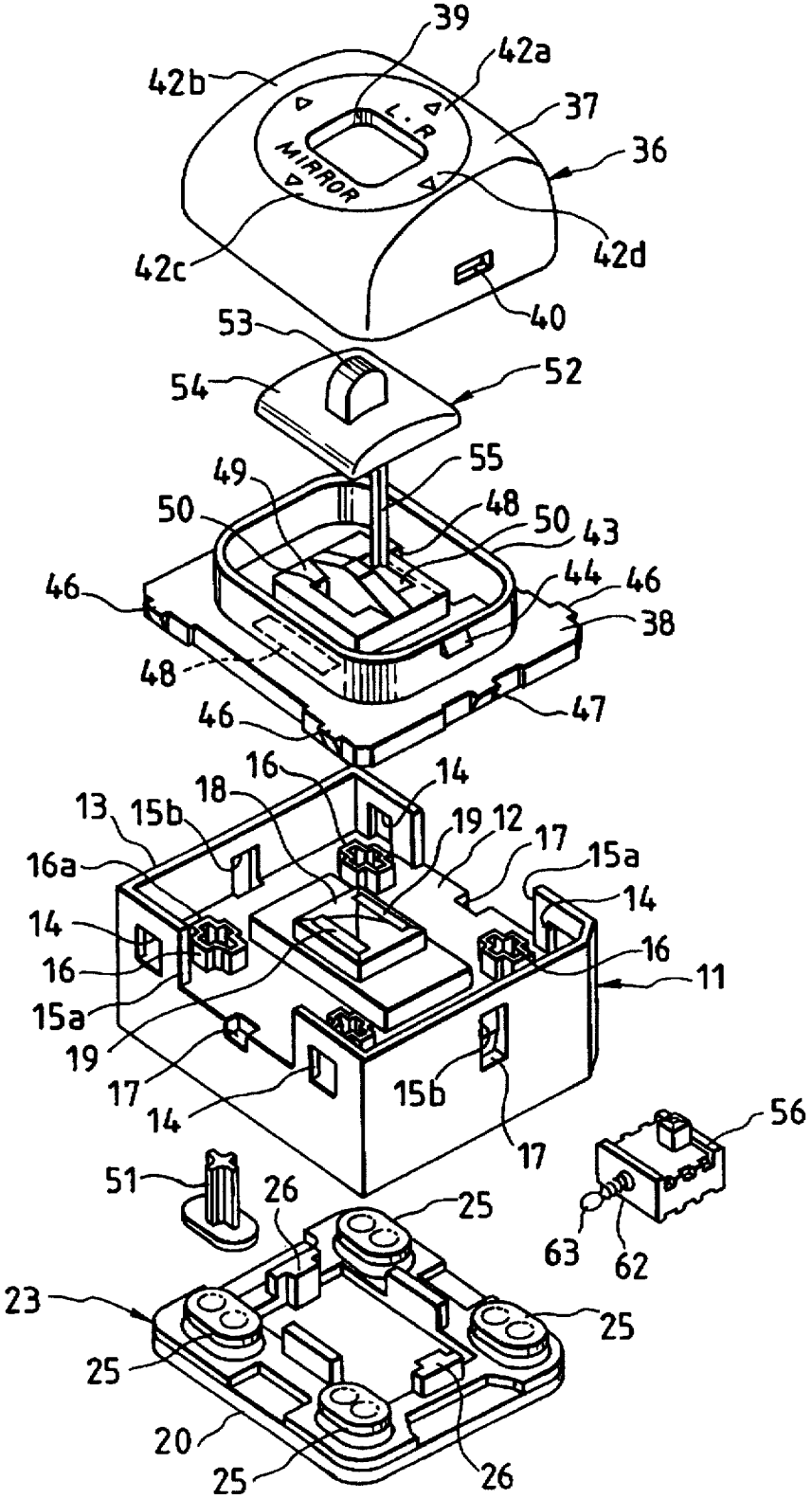
FIG. 4 is an exploded perspective view illustrating the principal component parts of the switching device according to the present invention.

In the following part, a description will be made of one example of a preferred embodiment of the present invention with reference to FIG. 1 through FIG. 8.

First, as shown in FIG. 1 through FIG. 4, a switch body formed in an approximately rectangular shape has a partition plate 12 set up therein to partition the inside region of the switch body into two parts, namely, the upper and lower areas of the switch body. A riser wall 13 formed in the upper portion of the switch body 11 has an engaging hole 14 made in each of four locations, namely, two in the front area and two in the rear area of the switch body 11. Further, a water drain opening 15*a* with its upper part kept open is formed in each of the two areas, namely, the front area and the rear area, and also a water drain opening 15*b* with its upper part kept closed is formed in each of the two locations, namely, the left area and the right area of the switch body 11.

The partition plate 12 mentioned above has a guide part 16 having an insertion hole 16*a* formed in an approximately cross shape in each of its four corners areas, and also a notched concave part 17 for draining the water is formed in each of the four locations. The upper part of each guide part 16 is formed at a level higher than the upper surface of the partition plate 12. The notched concave parts 17 formed in the four locations are respectively in intercommunication with the above-mentioned water drain opening 15*a* and 15*b*. Also, in an approximately central area of the partition plate 12, a protruding part 18 is formed to attain an elevation higher than the upper surface of the partition plate 12, and this protruding part 18 has a long insertion hole 19 formed in the leftward-rightward direction in each of two locations in its front and its rear respectively.

Figure 5:
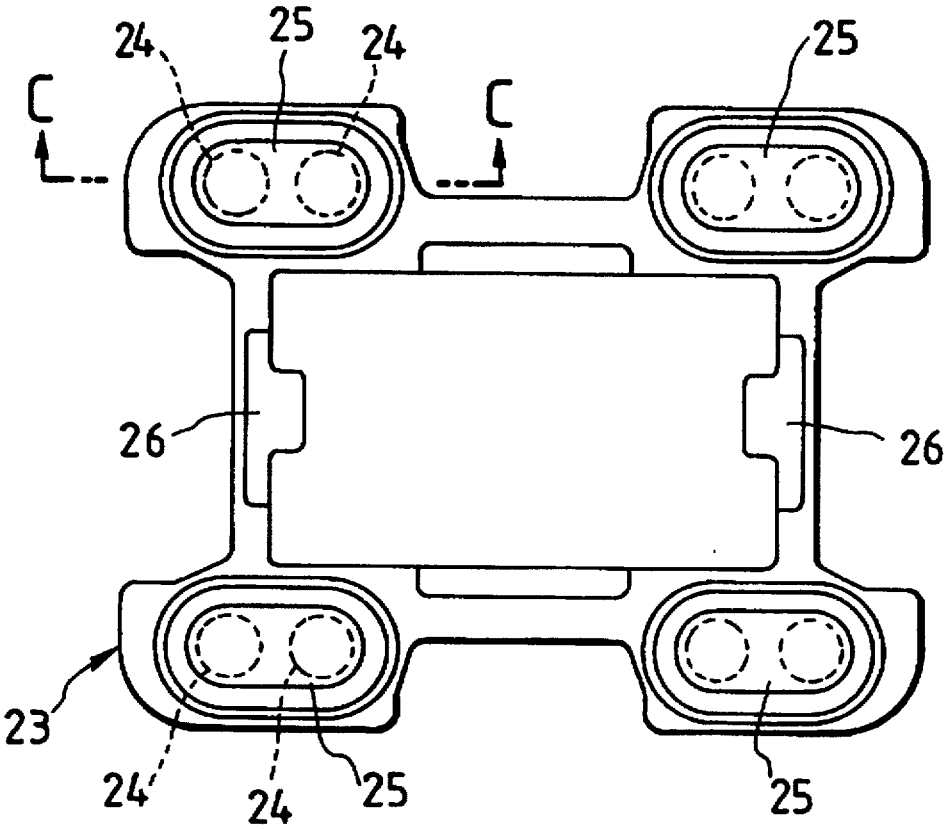
FIG. 5 is a plan view illustrating an elastic member of the switching device according to the present invention.
Figure 6:
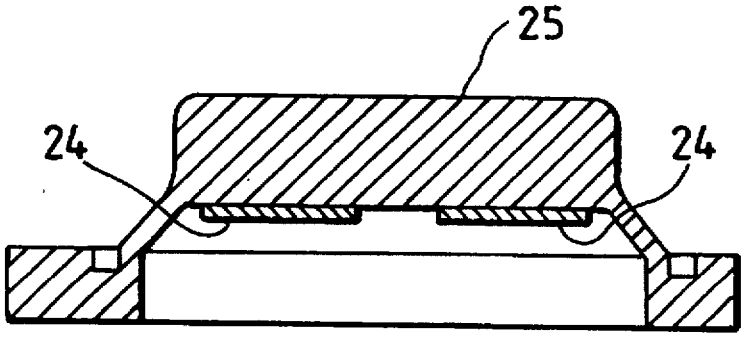
FIG. 6 is an enlarged sectional view of the elastic member taken along the line C—C as shown in FIG. 5.
Figure 7:
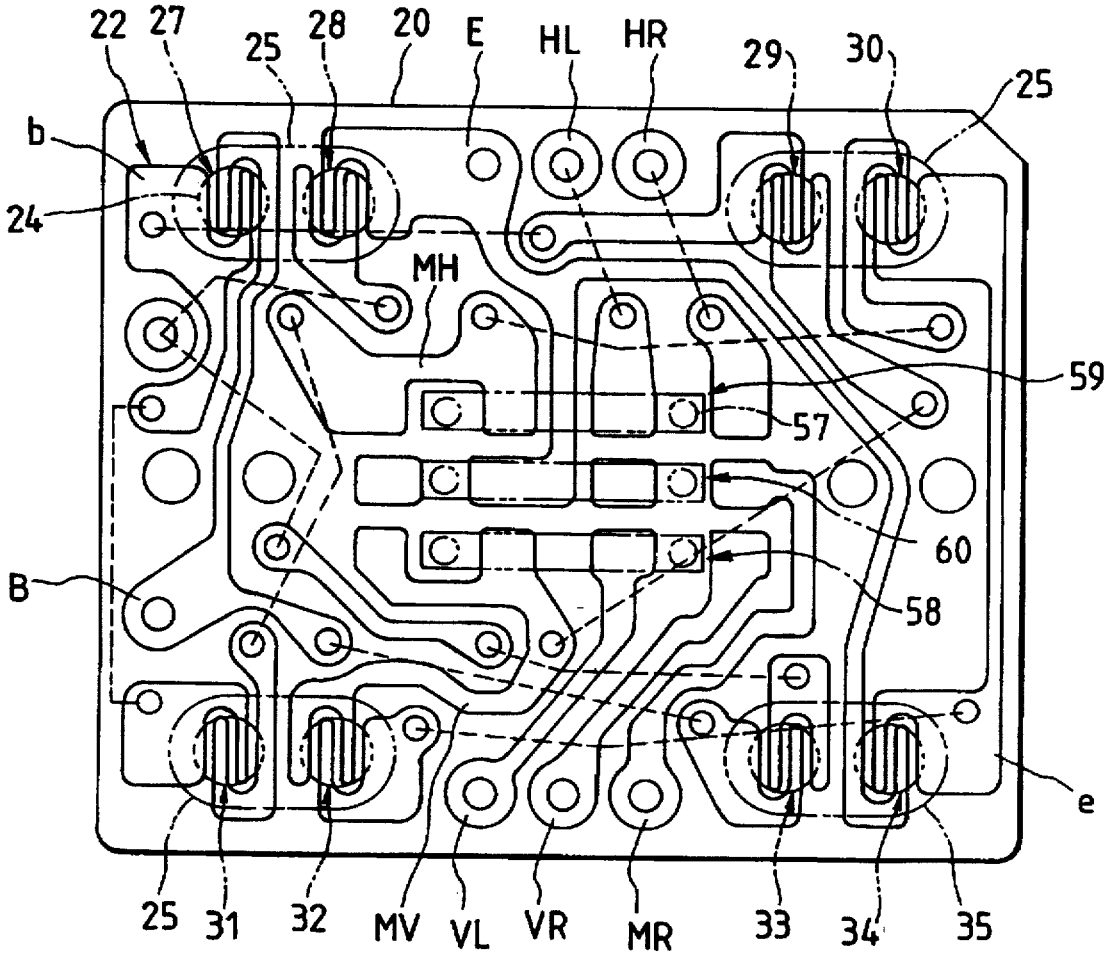
FIG. 7 is a plan view showing the wiring board of the present invention.

In the lower part of the switch body 11, a wiring board (or base board or base plate) 20 is disposed for use as a substrate, and also a connector 21 is provided below this wiring board 20. As shown in FIG. 7, a wiring pattern 22 is formed on the wiring board 20. Moreover, an elastic member 23, which is made, for example, of silicone rubber, is disposed on the wiring board 20, as shown in FIG. 5.

The elastic member 23 is formed in a rectangular frame shape as a whole and is provided with a contact holder part 25, which is elastically deformable and has two movable contacts 24 (Refer to FIG. 6) each on the inside surface of the four corners corresponding to the lower area of the guide part 16 mentioned above. Further, a buffering part 26, which is formed in an approximately T-letter shape, informed in two mutually confronting locations on the left and right shorter sides of the four sides of this elastic member 23 in such a manner that the buffering part 26 constitutes an integrated structure with this elastic member 23.

Figure 8:
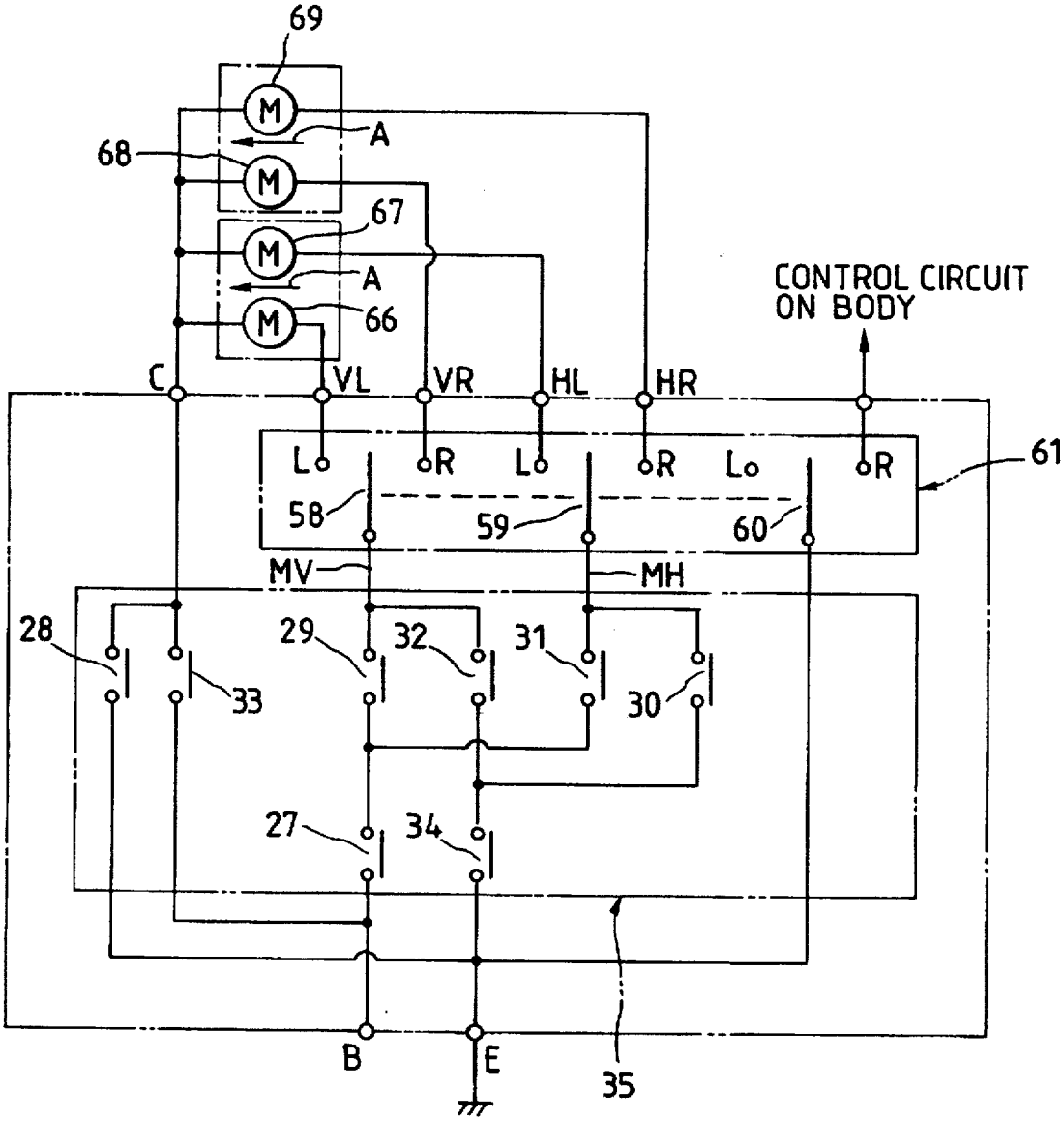
FIG. 8 is an electrical circuit diagram of the present invention.

Here, as shown in FIG. 7, the eight movable contacts 24 provided on the four contact holder parts 25 of the elastic member 23 and the stationary contacts of the wiring pattern 22 on the wiring board 20 together form eight switching elements 27 through 34, as shown in FIG. 7, and these switching elements 27 through 34 form an operating switch 35 for operating a motor for a mirror, as shown in FIG. 8.

On the upper area of the switch body 11, a first operating knob 36 formed in an approximately rectangular shape is disposed for its use as an operating knob. This first operating member 37 provided in its upper portion and a retaining member 38 provided in its lower portion. Of these component parts, the operating member 37 has an opening 39 formed in a rectangular shape in its central area, with an engaging hole 40 made in the side area between the left part and the right part. Further, the operating member 37 uses the portions between adjacent individual corner parts 41*a* through 41*d*, out of the corner areas 41*a* through 41*d* in the four locations, as operating parts 42*a* through 42*d* (Refer to FIG. 1). Four marks or characters each indicating an operating direction are displayed in positions corresponding to the operating parts 42*a* to 42*d* on the upper surface of the operating member 37.

In contrast with this, an annular wall 43 in a rectangular frame shape is formed on the upper surface of the retaining member 38, and the operating member 37 set so as to form a structure unified with the retaining member 38, with the engaging pawls 44 formed in both the left and right sides of this annular wall 43 being set in the engaging holes 40 made in the operating member 37. An empty area 45 is formed between these two members, namely, the operating member 37 and the retaining member 38.

Out of the peripheral edge portion of the retaining member 38, both the left and right side portions of the front edge portion and the rear edge portion have variable pawls 46 made of projecting parts formed in a total of four locations, and projecting parts 47 are formed in two locations in the left edge portion and the right edge portion. Of these parts, the four variable pawls 46 are respectively inserted into the above-mentioned engaging holes 14 made in the switch body 11 in such a manner as to permit each of them to move in the upward-downward direction, and the two projecting parts 47 are respectively inserted into the water drain openings 15*b* in such a manner as to permit each of them to move in the upward-downward direction.

Further, the retaining member 38 has a water drain hole 48 made in each of two locations positioned in the front part and the rear part of the outer retaining members and inside the annular wall 43. A protruding part 49, which is at a level higher than the surrounding area, is formed in the central area of the retaining member 38, and insertion holes 50 longer in the leftward-rightward direction and in its communication with the insertion hole 19 in the switch body 11, respectively, are made in two locations in this protruding part 49.

Then, a push rod 51 is inserted into an insertion hole 16*a* made in each of the guide parts 16 in four locations in the switch body 11. This push rod 51 is in direct contact at its lower end portion as set from above with the contact holder part 25, and its upper end portion is held in its direct contact, as set from below, with the lower surface of the retaining member 38 in the first operating knob 36. The first operating knob 36 is urged toward the neutral position by the elastic force applied by each contact holder part 25 by way of each push rod 51, and the first operating knob 36 is thereby kept ready for its swinging motion in any of the four directions, i.e., forward, backward, leftward, and rightward, in accordance with the pushing-in operations in the forward, backward, leftward, and rightward, of the operating parts 42*a* through 42*d* respectively provided in four locations, and the first operating knob 36 is thus constructed in such a manner as to operate the contact holder part 25 by applying its pressing force thereto via the push rod 51 in accordance with the direction of its sliding movement.

A second operating knob 52 for a changeover between the left and the right is provided in the inside of the first operating knob 36. This second operating knob 52 has an operating part 53 disposed in the opening 39 of the operating member 37, an eaves part 54, which is formed in a rectangular shape larger than the opening 39 and, being applied from above, covers up the insertion hole 50 of the retaining member 38, and a lever 55, which extends in the upward-downward direction, and the lever 55 is inserted into the insertion holes 50 and 19 made respectively in the rear sides of the retaining member 38 and the switch body 11.

The lower end portion of the lever 55 is fitted into the contact holder 56, and this contact holder 56 is disposed in an approximately central area of the above-mentioned wiring board 20 in such a manner as to be permitted to slide in the leftward-rightward direction. The contact holder 56 is provided with three movable contacts 57 (Refer to FIG. 7). These three movable contacts 57 and the stationary contacts provided in the central area of the wiring pattern 22 on the wiring board 20 form three sliding switches 58 through 60, and these three switches 58 through 60 constitute a changeover switch 61 for selecting one of the left mirror and the right mirror.

In the central area in the front of the contact holder 56, a spring 62 and a moderating piece 63 are provided, and, in correspondence with this, a moderating wall 64 (Refer to FIG. 2) is provided on the side of the switch body 11, and this spring 62, this moderating piece 63, and the moderating wall 64 together form a moderating mechanism 65.

Further, the contact holder 56 is constructed so as to be set into its sliding motion in the leftward-rightward direction by means of the second operating knob 52 and also to be held in a neutral position in the central area in the leftward-rightward direction and also in the leftward-rightward operating position by the action of the moderating mechanism 65. Moreover, the contact holder 56 is constructed in such a manner that an end portion of this contact holder 56 will be brought into its direct contact with the buffering part 26 when the contact holder 56 has moved to the sliding movement terminal position, which is an operating position for a leftward movement and a rightward movement.

In FIG. 8, which illustrates the electrical construction, the reference number 66 denotes a motor for an upward or downward adjustment of the mirror on the left side out of the left and right mirrors (not shown in FIG. 8), the reference number 67 similarly denotes a motor for a leftward or rightward adjustment of the mirror on the left side, and the reference number 68 denotes a motor for an upward or downward adjustment of the mirror on the right side, and the reference number 69 similarly denotes a motor for a leftward or rightward adjustment of the mirror on the right side. These motors are respectively connected as shown in FIG. 8. In FIG. 7, moreover, the parts indicated by the broken line show the pattern connected on the back side of the wiring board 20.

Then, the effects produced by the construction described above will be described.

When the second operating knob 52 is operated so as to slide it in the leftward direction, for example, in the state in which both the first operating knob 36 and the second operating knob 52 are held in the neutral position (Refer to FIGS. 1 to 3), the contact holder 56 will slide in the leftward direction by way of the lever 55, and, along with this, the individual sliding switches 58 through 60 of the changeover switch 61 are changed to the left side as shown in FIG. 8 and are kept in that state. By this, the motors 66 and 67 for the mirror on the left side are selected.

At this time, as the contact holder 56 is moved to the terminal position of its sliding movement on the left side, the left end portion of the contact holder 56 will be brought into its direct contact with the buffering member 26 on the left side, and the collision noises caused on such an occasion will therefore be reduced.

When the upward operating part **42*a* on the first operating knob 36 is operated so as to be pushed in while the second operating knob 52 is in the state of having been operated to be on the left side, the first operating knob 36 will be moved so as to be inclined toward the back side on the variable pawls 46 and 46 in the front edge area working as the supporting points, so that the contact holder parts 25 and 25 in two locations on the rear side are pushed down via the push rods 51 and 51, the four switching elements 27 through 30 on the rear side being thereby turned on. Then, in the construction shown in FIG. 8, an electric current flows in the direction marked by the arrow A to be applied to the motor 66** for an upward or downward adjustment of the mirror on the left side, and, along with this, the mirror on the left side is turned upward.

Moreover, when the operating force applied to the first operating knob 36 is released, the first operating knob 36 will be returned to the neutral position by the urging force exerted by the individual contact holder parts 25, and, at the same time, the individual switching elements 27 through 30 are put into an off-state.

When the downward operating part **42*c* of the first operating knob 36 is operated so as to be pushed in, the first operating knob 36 will be moved so as to be inclined toward the front side on the variable pawls 46 and 46 in the rear edge part working as the supporting points, so that the contact holder parts 25 and 25 provided in two locations on the front side are pressed down by way of the push rods 51 and 51, the four switching elements 31 through 34 on the front side being thereby turned on. Then, in the construction shown in FIG. 8, an electric current flows in the direction reverse to the direction indicated by the arrow A to be applied to the motor 66** for an upward or downward adjustment of the mirror on the left side, and, along with this, the mirror on the left side is turned downward.

Further, in case the leftward operating part **42*b* of the first operating knob 36 is operated so as to be pushed in, the first operating knob 36 will be moved so as to be inclined toward the left side on the variable hinges 46 and 46 on the right side working as the supporting points, so that the contact holders 25 and 25 provided in two locations on the left side are pressed down by way of the push rods 51 and 51, the four switching elements 27, 28, 31, and 32 on the left side are thereby turned on. Then, in the construction shown in FIG. 8, an electric current flows in the direction marked by the arrow A to be applied to the motor 67** for a leftward-rightward adjustment of the mirror on the left side, and, along with this, the mirror on the left side is turned leftward.

Further, in case the rightward operating part **42*d* of the first operating knob 36 is operated so as to be pushed in, the first operating knob 36 will be moved so as to be inclined toward the right side on the variable pawls 46 and 46 on the left side working as the supporting points, so that the contact holders 25 and 25 provided in two locations on the right side are pressed down by way of the push rods 51 and 51, the four switching elements 29, 30, 33, and 34 on the right side are thereby turned on. Then, in the construction shown in FIG. 8, an electric current flows in the direction reverse to the direction marked by the arrow A to be applied to the motors 68 and 69** for a leftward-rightward adjustment of the mirror on the right side, and, along with this, the mirror on the right side is turned rightward.

In the meantime, when the second operating knob 52 is operating so as to slide in the rightward direction, which is reverse to the direction mentioned above, in the state in which both the first operating knob 36 and the second operating knob 52 are held in the neutral position, the contact holder 56 will slide in the rightward direction by way of the lever 55, and, along with this, the individual sliding switches 58 through 60 of the changeover switch 61 are changed to the right side in the construction shown in FIG. 8, and the state is maintained. By this, the motors 68 and 69 for the mirror on the right side will be selected.

At such a time, as the contact holder 56 moves to the terminal point for the sliding movement on the right side, the right end portion of the contact holder 56 will be brought into its direct contact with the buffering part 26 provided on the right side of the elastic member 23, and the collision noises generated on that occasion are thereby reduced.

Further, in case the individual operating parts **42*a* through 42*d* of the first operating knob 36 are operated so as to be pushed in while the second operating knob 52 is operated for a movement to the right side, the motor 68 for an upward-downward adjustment of the mirror on the right side will be selected in stead of the motor 66 for an upward-downward adjustment of the mirror on the left side as described above and the motor 69 for a leftward-rightward adjustment of the mirror on the right side is selected in stead of the motor 67** for a leftward-rightward adjustment of the mirror on the left side, and, since the effect of the operations are the same except for these points, a description of the operations is omitted here.

On the other hand, in case any water happens to come into its contact, for example, with the first operating knob 36 and to intrude into the inside of the central area through the opening 39, the intrusive water will flow along the outer surfaces of the operating member 53 and the eaves part 54 of the second operating knob 52, and will be received by the retaining member 38 of the first operating knob 36. Then, the intrusive water flows down onto the partition plate 12 of the switch body 11 through the water drain hole 48 made on the side of the outer peripheral area of the retaining member 38 and will then be discharged to the outside of the switch body 11 through the notched concave part 17 and the water drain openings 15*a* and 15*b* .

Further, in a case in which water has intruded into the inside of the switch body 11 from the peripheral edge portion of the first operating knob 36, the intrusive water will be received on the partition plate 12 and will be discharged thereafter into an area outside of the switch body 11 through the notched concave part 17 and through the water drain openings 15*a* and 15*b* in the same way as in the case described above.

Yet, with such a switching device like the one described above, the four variable pawls 46 for the first operating knob 36 are provided, in general, in the square areas in four locations of the first operating knob 36. However, in case those variable pawls 46 are provided in the square areas of the first operating knob 36, even a slight change in the external shape of the first operating knob 36 for a change of its design or the like will result also in a change of the distance between the individual variable pawls 46, so that each such change requires that an examination should be conducted on each such occasion on the amount of the stroke of the first operating knob 36 and eventually on the amount of the elastic deformation and so on for each of the individual contact holder parts 25 in the elastic member 23.

In this respect, this example of preferred embodiment is provided with four variable pawls 46 of the first operating knob 36, but these variable pawls 46 are formed not in any square portion but in locations slightly closer to the central portion of the switch body 11 (Refer to FIG. 1), so that it will not be necessary to change the distance between the individual variable pawls 46 even in a case in which the external shape of the first operating knob 36 has been changed slightly in the leftward-rightward direction by reason of a design change or the like. Therefore, the construction of the switching device in this example of preferred embodiment offers the advantage that the construction does not require any case-by-case examination of the amount of stroke of the first operating knob 36 and the amount of elastic deformation and the like in each of the contact holder part 25 in the elastic member 23.

What is claimed is:

1. A multiple circuit switching device with a drain passage comprising:

a switch body;

a base plate provided in the switch body;

a first operating knob provided in the switch body so as to be pushed therein;

an elastic member arranged on the base plate, the elastic member including an elastically deformable contact holder portion for switching a first switching member in response to a pushing operation of the first operating knob;

a second operating knob provided near the first operating knob; and a contact holder for switching a second switching member in response to a switching operation of the second operating knob, the contact holder being slidably arranged on the basis plate, wherein the switch body includes at least one water drain aperture opening onto a side wall thereof, said side wall being perpendicular to said base plate.

2. A multiple circuit switching device with a drain passage comprising:

a switch body;

a base plate provided in the switch body;

a first operating knob provided in the switch body so as to be pushed therein;

an elastic member arranged on the base plate the an electric member including an elastically deformable contact holder portion for switching a first switching member in response to a pushing operation of the first operating knob;

a second operating knob provided near the first operating knob;

a contact holder for switching a second switching member in response to a switching operation of the second operating knob, the contact holder slidably arranged on the base plate, wherein the switch body includes at least one water drain opening at a side wall thereof, and wherein the first operating knob includes;

an operating member with a center portion provided in an upper portion of the first operating knob, the operating memeber including an opening of rectangular shape at the center portion thereof; and a retaining member provided in a lower portion of the first operating knob for connecting the operating member to the switch body, the retaining member including variable projections to connect to the water drain openings.

3. A multiple circuit switching device with a drain passage comprising:

a switch body having a partition member with an outer perimeter for partitioning an inside of the switching device into an upper part and a lower part;

a base board provided on the lower part;

an operating body including a first operating knob and a second operating knob, said first operating knob having a center;

a retaining member attached to a lower portion of the operating body and the upper part of the switch body so that a space is formed between the operating body and the retaining member, said retaining member having at least one penetration hole; p1 wherein the first operating knob is attached to the retaining member and disposed at the upper part, and the first operating knob has an opening at the center;

a first switch element provided on the base board, the first switch element switched in accordance with the operation of the first operating knob;

wherein the second operating knob is provided in the opening of the first operating knob such that the second operating knob faces the opening, and the second operating knob has a lever for penetrating said at least one penetration hole formed in the retaining member and the partition member;

a second switch element provided on the base board, the second switch element being switched trough the lever in accordance with the operation of the second operating knob;

a cover attached to the second operating knob, the cover covering the at least one penetration hole of the retaining; and a drain aperture guiding water dropped into the switch body out onto an outer side of the switch body; and wherein the retaining member includes a drain hole for guiding water received by the retaining member onto the outer perimeter of the partition member and wherein the drain aperture includes an opening for draining water on the partition member to the outside of the switch body.

4. A multiple circuit switching device with a drain passage comprising:

a switch body having a partition member for partitioning an inside of the switching device into an upper part and a lower part;

a base board provided on the lower part;

an operating body including a first operating knob and a second operating knob, said first knob operating having a center;

a retaining member attached to a lower portion of the operating body and the upper part of the switch body so that a space is formed between the operating body and the retaining member, said retaining member having at least one penetration hole;

wherein the first operating knob is attached to the retaining member and disposed at the upper part, and the first operating knob has an opening at the center;

a first switch element provided on the base board, the first switch element being switched in accordance with the operation of the first operating knob;

wherein the second operating knob is provided in the opening of the first operating knob such that the second operating knob faces the opening, and the second operating knob has a lever for penetrating said at least one penetration hole formed in the retaining member and the partition member;

a second switch element provided on the base board, the second switch element being switched through the lever in accordance with the operation of the second operating knob;

a cover attached to the second operating knob, the cover covering the at least one penetration hole of the retaining member; and a drain aperture guiding water dropped into the switch body out onto an outer side of the switch body;

wherein the opening at the center of the first operating knob is rectangular in shape; and wherein the retaining member includes variable projections to connect to the drain aperture.

* * * * *

UNITED STATES PATENT AND TRADEMARK OFFICE

CERTIFICATE OF CORRECTION

PATENT NO. : 5,682,978

DATED : November 04, 1997

INVENTOR(S) : Toshihiro KAWASE

It is certified that error appears in the above-indentified patent and that said Letters Patent is hereby corrected as shown below:

In Claim 2, Column 8, lines 21-22, "plate the an electric" should read --plate, the elastic--.

In Claim 2, Column 8, line 39, "memeber" should read --member--.

In Claim 3, Column 8, line 60, after "hole;", delete "pl" and insert a line break before "wherein".

In Claim 3, Column 9, line 8, "trough" should read --through--.

Signed and Sealed this

Twenty-eighth Day of April, 1998

Bruce Lehman

*Attest:*

BRUCE LEHMAN

*Attesting Officer*

*Commissioner of Patents and Trademarks*